US010751890B1

(12) United States Patent
Marfione

(10) Patent No.: US 10,751,890 B1
(45) Date of Patent: Aug. 25, 2020

(54) FOLDING KNIFE

(71) Applicant: Anthony Louis Marfione, Fletcher, NC (US)

(72) Inventor: Anthony Louis Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/674,715

(22) Filed: Nov. 5, 2019

(51) Int. Cl.
*B26B 1/04* (2006.01)

(52) U.S. Cl.
CPC ..... *B26B 1/044* (2013.01)

(58) Field of Classification Search
CPC ..... B26B 1/044
USPC ..... 30/161
See application file for complete search history.

(56) References Cited

U.S. PATENT DOCUMENTS

| | | | |
|---|---|---|---|
| 1,056,404 | A | 3/1913 | Lorenzo |
| 1,231,058 | A | 6/1917 | Pansa |
| 2,854,745 | A | 10/1958 | Braverman |
| 4,089,112 | A | 5/1978 | Richards |
| D265,719 | S | 8/1982 | Dowdy |
| D276,887 | S | 12/1984 | Sakurai |
| 4,523,379 | A | 6/1985 | Osterhout |
| 4,744,146 | A | 5/1988 | Schmidt |
| 4,947,552 | A | 8/1990 | Barnes |
| 5,060,379 | A | 10/1991 | Neely |
| D347,375 | S | 5/1994 | Sakai |
| 5,502,895 | A | 4/1996 | Lemaire |
| 5,511,311 | A | 4/1996 | Collins |
| 5,617,635 | A | 4/1997 | Berns |
| D385,173 | S | 10/1997 | McWillis |
| D387,966 | S | 12/1997 | Horn |
| D389,389 | S | 1/1998 | Glesser |
| 5,819,414 | A | 10/1998 | Marifone |
| D407,002 | S | 3/1999 | Morton |
| D407,004 | S | 3/1999 | Hull |
| 6,085,423 | A | 7/2000 | Marifone |
| 6,101,724 | A | 8/2000 | Halligan |
| 6,148,522 | A | 11/2000 | Dobandi |
| D435,421 | S | 12/2000 | Strider |
| 6,154,965 | A | 12/2000 | Sakai |
| D438,443 | S | 3/2001 | Keating |
| D464,246 | S | 10/2002 | Sloan |
| D473,917 | S | 4/2003 | Carter, III |
| D474,669 | S | 5/2003 | Onion |
| 6,668,460 | B2 * | 12/2003 | Feng ..... B26B 1/042 30/155 |
| D488,045 | S | 4/2004 | Onion |
| D505,057 | S | 5/2005 | Ralph |
| D510,249 | S | 10/2005 | Ray |

(Continued)

*Primary Examiner* — Hwei-Siu C Payer
(74) *Attorney, Agent, or Firm* — Steve LeBlanc, LLC

(57) ABSTRACT

A folding knife includes a handle having a butt end opposed to a head end. A blade is pivotally connected to the head end of the handle. The blade has a cutting edge, a retracted position in which at least a portion of the cutting edge is inside the handle, and an extended position in which a majority of the cutting edge is outside the handle. A spring bar is connected to the handle and has a first end biased toward the blade at the head end of the handle. An insert is connected to the first end of the spring bar and separates the first end of the spring bar from the blade when the blade moves between the retracted and extended positions.

16 Claims, 5 Drawing Sheets

(56) References Cited

U.S. PATENT DOCUMENTS

| | | | | |
|---|---|---|---|---|
| 7,032,315 | B1 * | 4/2006 | Busse | B26B 1/048 30/153 |
| 7,086,158 | B1 | 8/2006 | Halpern | |
| 7,305,729 | B2 | 12/2007 | Dehner | |
| 7,305,769 | B2 | 12/2007 | McHenry | |
| D567,055 | S | 4/2008 | Renzi | |
| D578,857 | S | 10/2008 | Yang-Fu | |
| D613,754 | S | 4/2010 | Barcheck | |
| D614,933 | S | 5/2010 | Freeman | |
| 7,797,838 | B2 | 9/2010 | Chu | |
| D636,051 | S | 4/2011 | Freeman | |
| 7,979,990 | B2 | 7/2011 | Hawk et al. | |
| 8,028,419 | B2 | 10/2011 | VanHoy | |
| D677,551 | S | 3/2013 | Pelton | |
| D697,780 | S | 1/2014 | Pelton | |
| 8,671,578 | B1 | 3/2014 | Frazer | |
| D706,107 | S | 6/2014 | Pelton | |
| D737,110 | S | 8/2015 | Schuft | |
| D743,769 | S | 11/2015 | Glesser | |
| D753,459 | S | 4/2016 | Glesser | |
| D765,217 | S | 8/2016 | Tom | |
| D768,456 | S | 10/2016 | Cheng | |
| D768,458 | S | 10/2016 | Mingyi | |
| D769,694 | S | 10/2016 | Mingyi | |
| 9,573,282 | B1 | 2/2017 | Sheahan | |
| 10,071,489 | B2 * | 9/2018 | MacNair | B26B 1/044 |
| D856,109 | S | 8/2019 | Marfione | |
| D856,775 | S | 8/2019 | Marfione | |
| 2004/0045170 | A1 * | 3/2004 | Glesser | B26B 1/04 30/161 |
| 2005/0044717 | A1 | 3/2005 | Nishihara | |
| 2005/0252010 | A1 | 11/2005 | Freeman | |
| 2006/0143929 | A1 | 7/2006 | Lake | |
| 2007/0204468 | A1 | 9/2007 | Cheng | |
| 2012/0180320 | A1 | 7/2012 | Lo | |
| 2012/0304470 | A1 | 12/2012 | Freeman | |
| 2014/0345145 | A1 * | 11/2014 | Frazer | B26B 1/02 30/161 |
| 2015/0367520 | A1 | 12/2015 | MacNair | |
| 2018/0169875 | A1 * | 6/2018 | Valdez | B25G 3/38 |

* cited by examiner

FOLDING KNIFE

FIELD OF THE INVENTION

The present invention generally involves a folding knife. In particular embodiments, the folding knife may be manually operated, single action, or double action.

BACKGROUND OF THE INVENTION

Pocket knives provide a convenient tool for cutting that may be easily carried by a user. A folding knife is a particular style of pocket knife that has a blade pivotally connected to a handle. The handle generally has a butt end opposed to a head end and a back surface opposed to a front surface. The blade pivots with respect to the head end of the handle to transition between retracted and extended positions. When retracted, a cutting edge of the blade resides inside the front surface of the handle, and the handle protects the cutting edge from inadvertent contact that might damage the cutting edge or cause personal injury. When extended, the blade extends from the head end of the handle to expose the cutting edge for use.

A manually operated folding knife requires a user to physically rotate the blade with respect to the head end of the handle to reposition the blade between the retracted and extended positions. A single action folding knife includes a spring that engages with the blade to automatically extend the blade, and the user must apply force to the blade to overcome the spring force to manually pivot the blade with respect to the head end of the handle to return the blade to the retracted position. A double action folding knife includes a spring that engages with the blade to automatically extend and retract the blade.

Folding knife designs often balance competing goals of safety with ease of operation. For example, some folding knife designs include a lock to enhance safety. The lock engages when the blade is extended and/or retracted to prevent inadvertent movement of the blade between the extended and retracted positions. The additional safety provided by the lock generally requires additional action to release the lock before repositioning the blade between the extended and retracted positions and therefore reduces the ease of operation of the folding knife. Other folding knives are non-locking to enhance ease of operation. For example, a slip joint knife is a non-locking folding knife that securely holds, but does not lock, the blade in the retracted or extended positions. A slip joint knife typically includes a cantilever or a spring bar attached to the butt end of the handle and that extends along the back surface of the handle to the head end of the handle. At the head end of the handle, the cantilever or spring bar is biased against the blade to securely hold the blade in the retracted and extended positions. To reposition the slip joint knife between the retracted and extended positions, a force is applied to the blade to overcome the force of the cantilever or spring bar against the blade.

It is desirable for a slip joint knife to operate reliably over decades of use and through thousands of cycles between the retracted and extended positions, and the material selected for the cantilever or spring bar must balance flexibility with hardness to provide the desired reliability and durability. Titanium or steel is typically used for the cantilever or spring bar because these materials possess sufficient strength and flexibility to provide the desired bias against the blade to securely hold the blade in the retracted and extended positions. However, titanium and steel are generally softer than most blades that are heat treated or hardened. As a result, repeated cycles of the blade between extended and retracted positions causes the blade to erode the surface of the titanium or steel cantilever or spring bar which adversely impacts reliable operation of knife. Eventually, the titanium or steel cantilever or spring bar must be replaced to allow the slip joint knife to operate reliably.

Therefore, the need exists for an improved folding knife that can securely hold the blade in the retracted and extended positions while also providing enhanced durability to reduce the need for repairs and maintenance.

BRIEF DESCRIPTION OF THE INVENTION

Aspects and advantages of the invention are set forth below in the following description, or may be obvious from the description, or may be learned through practice of the invention.

One embodiment of the present invention is a folding knife that includes a handle having a butt end opposed to a head end and a back surface that extends between said butt end and said head end. A blade has a tang and a cutting edge, and the tang of the blade pivotally connects the blade to the handle at the head end of the handle. The blade has a retracted position in which at least a portion of the cutting edge is inside the handle and an extended position in which a majority of the cutting edge is outside the handle. A spring bar is connected to the handle, extends along the back surface of the handle, and is biased toward the tang of the blade at the head end of the handle. An insert is releasable connected to the spring bar and separates the spring bar from the tang of the blade when the blade moves between the retracted and extended positions.

An alternate embodiment of the present invention is a folding knife that includes a handle having a butt end opposed to a head end. A blade is pivotally connected to the head end of the handle. The blade has a cutting edge, a retracted position in which at least a portion of the cutting edge is inside the handle, and an extended position in which a majority of the cutting edge is outside the handle. A spring bar is connected to the handle and has a first end biased toward the blade at the head end of the handle. An insert is connected to the first end of the spring bar and separates the first end of the spring bar from the blade when the blade moves between the retracted and extended positions.

In yet another embodiment of the present invention, a folding knife includes a handle having a butt end opposed to a head end. A blade is pivotally connected to the head end of the handle. The blade has a cutting edge, a retracted position in which at least a portion of the cutting edge is inside the handle, and an extended position in which a majority of the cutting edge is outside the handle. A cantilever is connected to the handle and is biased toward the blade at the head end of the handle. An insert is connected to the cantilever and separates the cantilever from the blade when the blade moves between the retracted and extended positions.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
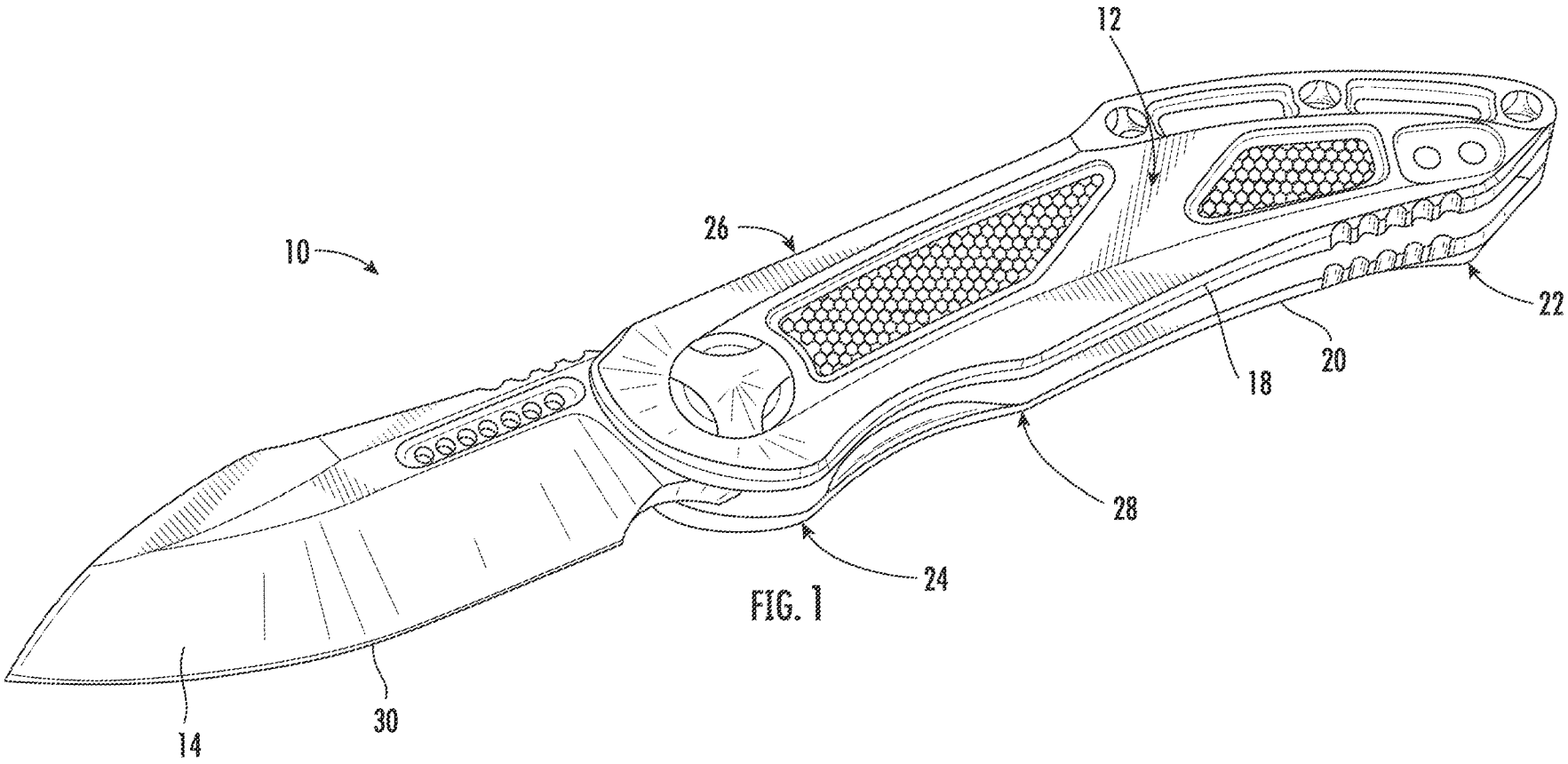
FIG. 1 is a from perspective view of a folding knife according to one embodiment of the present invention in an extended position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention is a folding knife with an insert that holds the folding knife in retracted and extended positions. The insert allows the folding knife to operate reliably, also reducing the cost and/or frequency of repairs. Although various embodiments are illustrated as a manual folding, knife, one of ordinary skill in the art will readily appreciate that embodiments of the present invention may include a single or double action folding knife, and the present invention is not limited to a particular configuration or action unless specifically recited in the claims.

Figure 2:
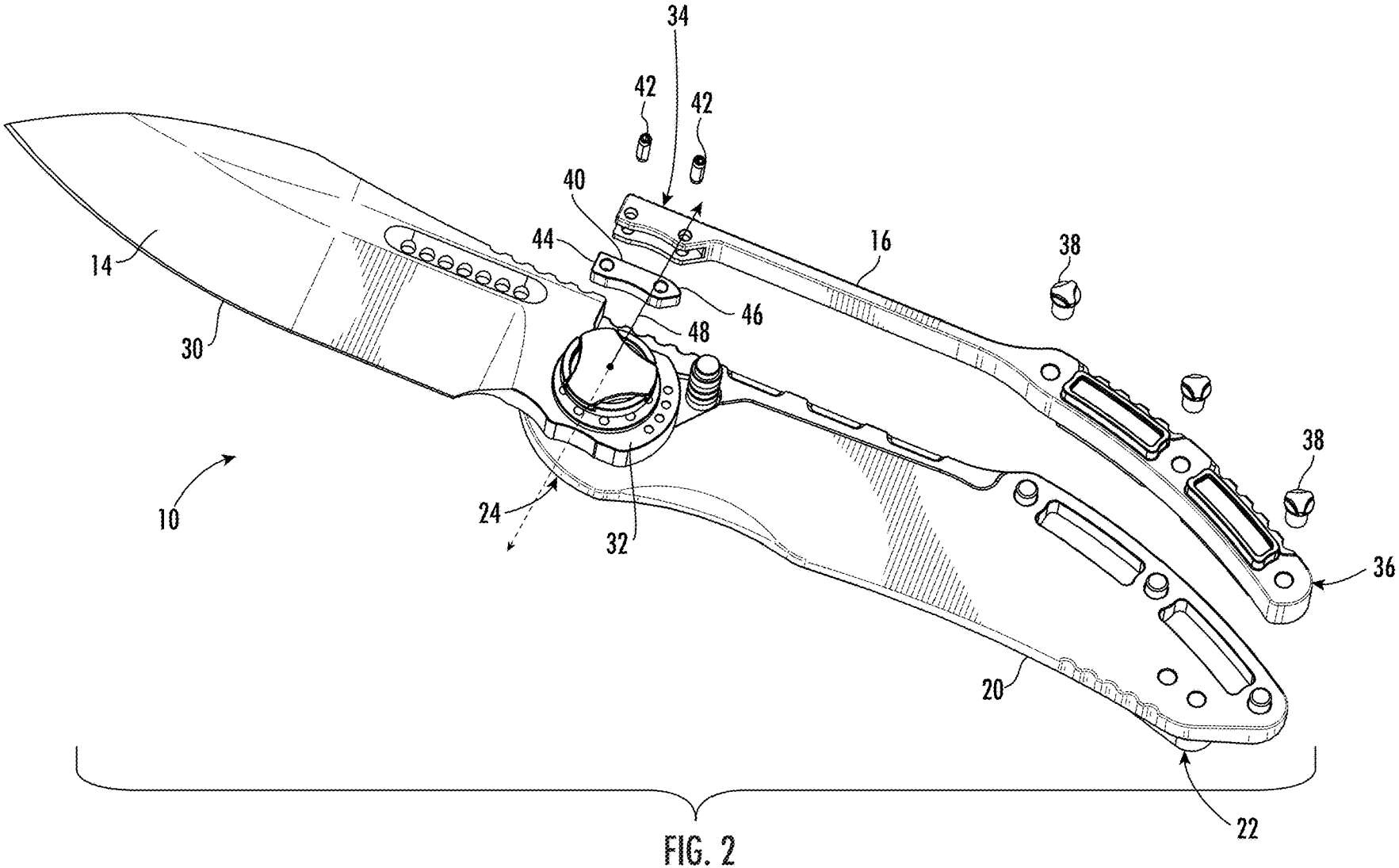
FIG. 2 is an exploded perspective view of the folding knife shown in FIG. 1 with the top scale removed.

FIG. 1 provides a front perspective view of a folding knife 10 according to one embodiment of the present invention, and FIG. 2 provides an exploded perspective view of the folding knife shown in FIG. 1 with the top scale removed. As shown in FIGS. 1 and 2, the folding knife 10 generally includes a handle 12, a blade 14, and a spring bat 16. The handle 12 houses, and supports the blade 14 and provides the primary structure for holding the folding knife 10 during use. The handle 12 may be constructed from metal, fiberglass, carbon, polymers, or other composite materials known in the art, and the outside of the handle 12 may include various textured surfaces to facilitate handling and gripping the folding knife 10. The handle 12 may be a single-piece construction, but more commonly includes top and bottom scales 18, 20 connected together on opposing sides of the blade 14. For convention of reference, the handle 12 has a butt end 22 opposed to a head end 24, and a back surface 26 and a front surface 28 extend on opposing sides between the butt end 22 and the head end 24. As used herein, the butt end 22 and head end 24 refer to general areas of the handle 12 and not necessarily the extreme ends of the handle 12.

The blade 14 is typically made of hardened or heat-treated steel, titanium, or other suitable material and generally includes a cutting edge 30 along one side and a tang 32 at one end. In particular embodiments, the cutting edge 30 may be curved, straight, and/or serrated. The tang 32 generally refers to the unsharpened, unexposed portion of the blade 14 sandwiched between the top and bottom scales 18, 20. The tang 32 pivotally connects the blade 14 to the handle 12 at the head end 24 of the handle 12. In this manner, the blade 14 has an extended position (shown in FIGS. 1, 2, and 4) in which the cutting edge 30 extends outside the handle 12 from the head end 24 of the handle 12 and a retracted position (shown in FIG. 3) in which the cutting edge 30 is inside the handle 12.

The spring bar 16, also referred to as a cantilever, applies force to the tang 32 of the blade 14 to hold, but not lock, the blade 14 in the extended and retracted positions. The spring bar 16 is constructed of material that is sufficiently strong to hold the blade 14 in the extended and retracted positions, while also possessing sufficient flexibility and memory to bend without fracturing or plastically deforming to allow the blade 14 to move between the extended and retracted positions. Suitable materials for the spring bar 16 or cantilever include titanium, steel, and other sufficiently strong and flexible materials selected to complement the aesthetic appearance of the folding knife 10.

The spring bar 16 or cantilever connects to the handle 12 and extends along at least a portion of the handle 12. For example, the spring bar 16 may extend along the back surface 26 of the handle 12 so that the spring bar 16 is flush with the back surface 26. The spring bar 16 generally includes a first end 34 opposed to a second end 36. The second end 36 of the spring bar 16 may connect to the handle 12 by press fit between the top and bottom scales 18, 20. Alternately, as shown in FIG. 2, one or more screws 38 may connect the spring bar 16 to the handle 12, with the second end 36 of the spring bar 16 connected to the handle 12 at the butt end 22 of the handle 12. In this manner, the curvature of the spring bar 16 causes the first end 34 of the spring bar 16 to be biased toward the tang 32 of the blade 14 at the head end 24 of the handle 12.

As shown in FIG. 2, the folding knife 10 further includes an insert 40 connected to the spring bar 16 or cantilever to separate the spring bar 16 or cantilever from the tang 32 of the blade 14. The insert 40 may have a first end 44 opposed to a second end 46, with the first end 44 of the insert 40 closer to the head end 24 of the handle 12 than the second end 46 of the insert 40. The insert 40 may extend 0.010-0.020 inches from the spring bar 16 to separate the spring bar 16 from the blade 14. As a result, the tang 32 of the blade 14 slides against the insert 40, instead of the spring bar 16 or cantilever, when the blade 14 moves between the retracted and extended positions. In this manner, the insert 40 prevents the harder tang 32 or blade 14 from eroding the softer spring bar 16 or cantilever. As shown in FIG. 2, the insert 40 may be releasably connected to the first end 34 of the spring bar 16 or cantilever using pins 42, screws, or similar devices. As a result, the insert 40 may be more easily replaced when needed, compared to replacing the entire spring bar 16 or cantilever.

The insert 40 does not have to possess the same flexibility characteristics as the spring blade 16 or cantilever. Therefore, in particular embodiments, the insert 40 may be constructed of material that is harder and less flexible than the spring bar 16 or cantilever to provide enhanced durability. For example, the insert 40 may be constructed from 17-4 pH hardened steel or other tempered material so that the insert hardness is greater than the spring bar 16 or cantilever hardness. As used herein, "hardness" is a measure of the resistance to localized plastic deformation induced by either mechanical indentation or abrasion and may be determined by various tests known to one of ordinary skill in the art, such as the Brinell or Rockwell hardness tests.

The relative movement between the blade 14 and the spring bar 16 is shown most clearly with reference to FIG. 2. As shown in FIG. 2, the tang 32 of the blade 14 pivotally connects the blade 14 to the handle 12 so that the blade 14 may rotate around an axis 48 at the head end 24 of the handle 12. The spring bar 16 connected to the handle 12 is biased orthogonal to the axis 48 toward the tang 32 of the blade 14 at the head end 24 of the handle 12. In this manner, the first end 34 of the spring bar 16 constantly applies force against the tang 32 of the blade 14.

Figure 4:
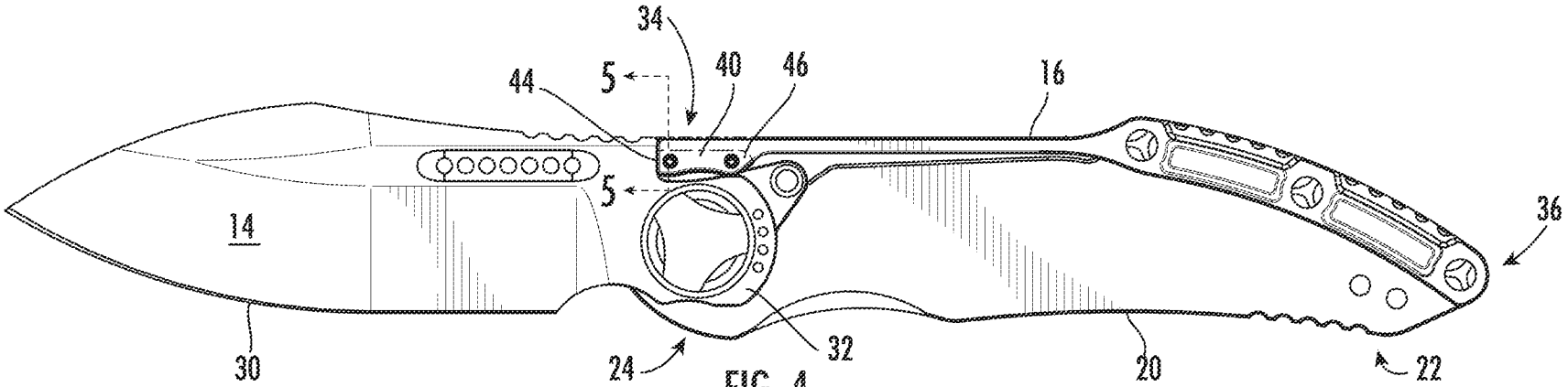
FIG. 4 is a side plan view of the folding knife shown in FIG. 1 in, the extended position with the top scale removed.
Figure 5:
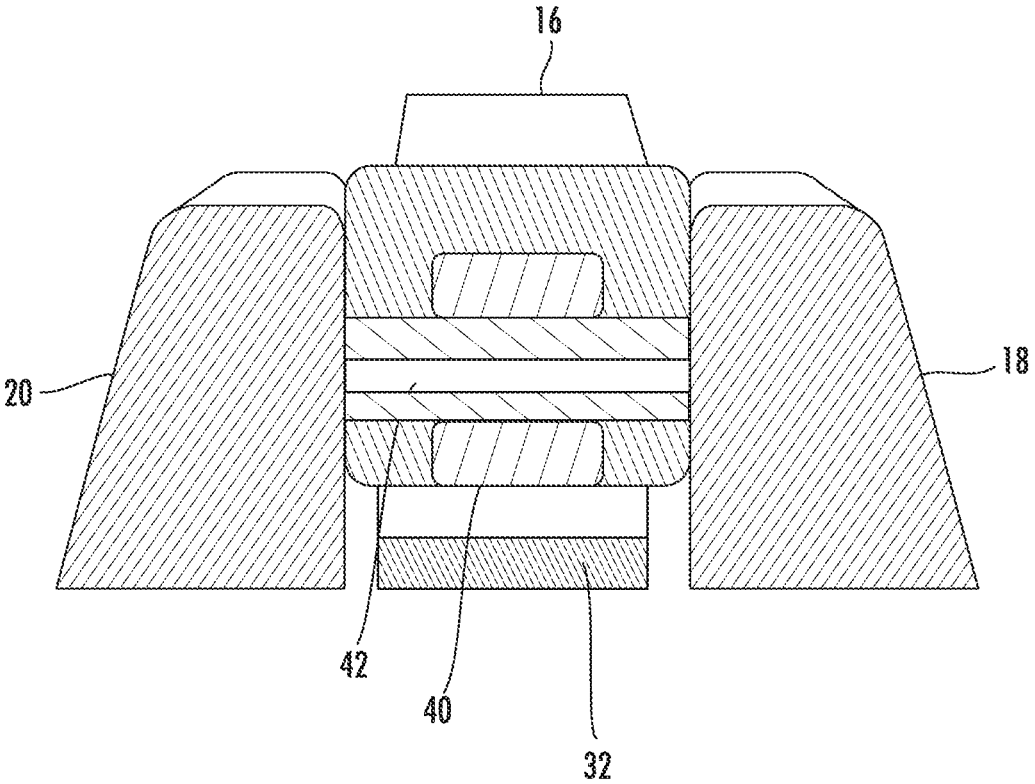
FIG. 5 is a cross-section view of the folding knife shown in FIG. 4 taken along line 5-5.

Operation of the folding knife 10 will now be described with respect to FIGS. 3-5. In the retracted position shown in FIG. 3, the cutting edge 30 of the blade 14 is inside the handle 12. The first end 34 of the spring bar 16 or cantilever is biased toward the tang 32 of the blade 14, pressing the first end 44 of the insert 40 against the tang 32 to hold the blade 14 in the retracted position. To reposition the blade 14 to the extended position shown in FIG. 4, a user holds the handle 12 with one hand and pulls the blade 14 from the from surface 28 of the handle 12 with the other hand with sufficient force to cause the tang 32 of the blade 14 to slide against the first end 44 of the insert 40 to overcome the bias force being applied by the spring bar 16 or cantilever. The curved portion of the tang 32 continues to slide against the insert 40 as the blade 14 pivots around the head end 24 of the handle 12 (clockwise as shown in FIG. 3), As the blade 14 approaches the fully extended position, the bias force applied by the spring bar 16 or cantilever snaps the blade 14 into the fully extended position as shown in FIG. 4, with the first end 34 of the spring bar 16 or cantilever pressing the second end 46 of the insert 40 against the tang 32 to hold the blade 14 in the extended position.

Figure 3:
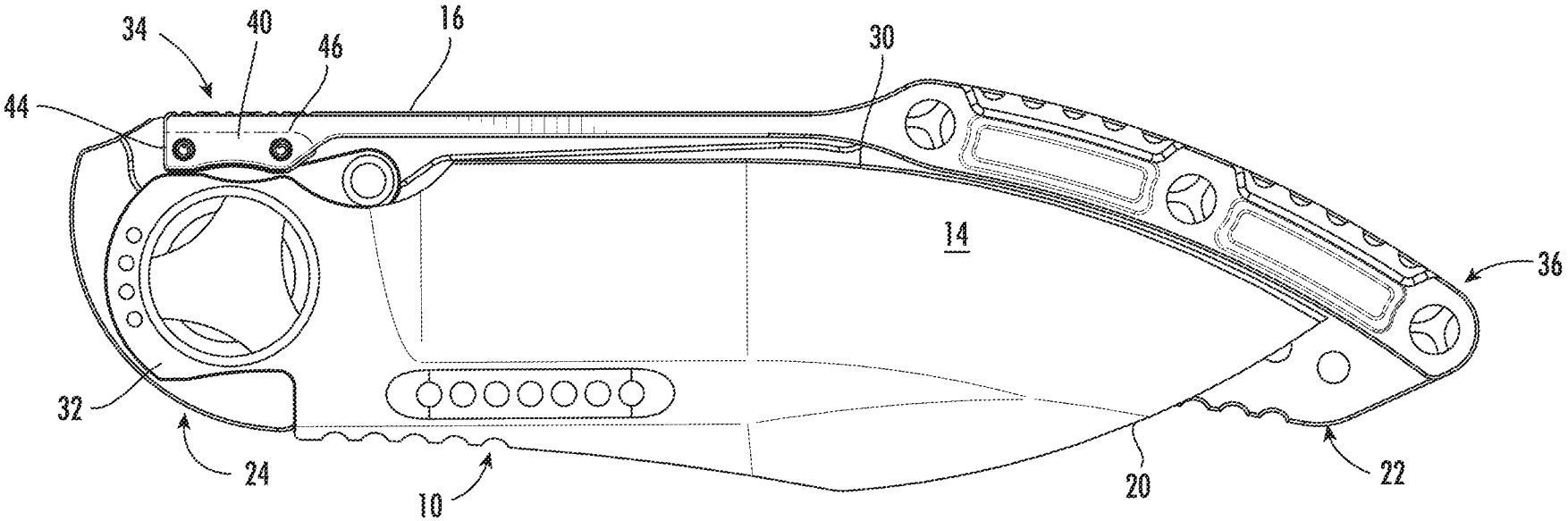
FIG. 3 is a side plan view of the folding knife shown in FIG. 1 in a retracted position with the top scale removed.

To reposition the blade 14 to the retracted position shown, in FIG. 3, a user holds the handle 12 with one hand and pushes against the blade 14 with the other hand with sufficient force to cause the tang 32 of the blade 14 to slide against the second end 46 of the insert 40 to overcome the bias force being applied by the spring bar 16 or cantilever. Since the second end 46 of the insert 40 is further from the head end 24 of the handle 12, the initial force required to overcome the bias force being applied by the spring bar 16 or cantilever is greater when retracting the blade 14 than the initial force required to overcome the bias force being applied by the spring bar 16 or cantilever when extending the blade 14. The curved portion of the tang 32 continues to slide against the insert 40 as the blade 14 pivots around the head end 24 of the handle 12 (counterclockwise as shown in FIG. 4). As the blade 14 approaches the fully retracted position, the bias force applied by the spring bar 16 or cantilever snaps the blade 14 into the fully retracted position as shown in FIG. 3, with the first end 34 of the spring bar 16 or cantilever pressing the first end 44 of the insert 40 against the tang 32 to hold the blade 14 in the retracted position.

The embodiments of the folding knife 10 described and illustrated in FIGS. 1-5 thus provide reliable operation while also reducing the cost and/or frequency of repairs or maintenance. Specifically, the tang 32 slides against the insert 40, instead of the spring bar 16 or cantilever, when the blade 14 moves between the retracted and extended positions. As a result, the insert 40 protects the spring bar 16 or cantilever from erosion or damage that may be caused by repeated friction between the tang 32 and the spring bar 16 or cantilever. In particular embodiments, the insert 40 may be constructed from 17-4 pH hardened steel or other tempered material to reduce any wear of the insert 40 due to repeated friction against the tang 32 of the blade 14. Alternately or in addition, the insert 40 may be releasably connected to the spring bar 16 or cantilever to facilitate replacement of the insert 40 when necessary, without, requiring the more costly replacement of the spring bar 16 or cantilever.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A folding knife, comprising:

a handle, wherein said handle has a butt end opposed to a head end thereof and a back surface that extends between said butt end and said head end;

a blade having a tang and a cutting edge, wherein said tang of said blade pivotally connects said blade to said handle around an axis at said head end of said handle, said blade has a retracted position in which at least a portion of said cutting edge is inside said handle, and said blade has an extended position in which a majority of said cutting edge is outside said handle;

a spring bar connected to said handle at said butt end of said handle, wherein said spring bar extends along said back surface of said handle and is biased orthogonal to said axis toward said tang of said blade at said head end of said handle; and an insert releasably connected to said spring bar, wherein said insert separates said spring bar from said tang of said blade when said blade moves between said retracted and extended positions, wherein said insert has a first end opposed to a second end thereof, said first end of said insert is closer to said head end of said handle than said second end of said insert, and said second end not said first end of said insert is biased against said tang of said blade when said blade is in said extended position.

2. The folding knife as in claim 1, wherein said tang of said blade slides against said insert when said blade moves between said retracted and extended positions.

3. The folding knife as in claim 1, wherein said insert has an insert hardness, said spring bar has a spring bar hardness, and said insert hardness is greater than said spring bar hardness.

4. The folding knife as in claim 1, wherein said first end of said insert is biased against said tang of said blade when said blade is in said retracted position.

5. A folding knife, comprising:

a handle, wherein said handle has a butt end opposed to a head end thereof;

a blade pivotally connected around an axis to said head end of said handle, wherein said blade has a tang, a cutting edge, a retracted position in which at least a portion of said cutting edge is inside said handle, and an extended position in which a majority of said cutting edge is outside said handle;

a spring bar connected to said handle, wherein said spring bar has a first end biased orthogonal to said axis toward said blade at said head end of said handle; and an insert connected to said first end of said spring bar, wherein said insert separates said first end of said spring bar from said blade when said blade moves between said retracted and extended positions, and wherein said insert has a first end opposed to a second end thereof, said first end of said insert is closer to said head end of said handle than said second end of said insert, and said second end not said first end of said insert is biased against said tang of said blade when said blade is in said extended position.

6. The folding knife as in claim 5, wherein said spring bar has a second end opposed to said first end and said second end of said spring bar is connected to said handle at said butt end of said handle.

7. The folding knife as in claim 5, wherein said blade slides against said insert when said blade moves between said retracted and extended positions.

8. The folding knife as in claim 5, wherein said insert has an insert hardness, said spring bar has a spring bar hardness, and said insert hardness is greater than said spring bar hardness.

9. The folding knife as in claim 5, wherein said first end of said insert is biased against said tang of said blade when said blade is in said retracted position.

10. The folding knife as in claim 5, wherein said insert is releasably connected to said first end of said spring bar.

11. A folding knife, comprising:

a handle, wherein said handle has a butt end opposed to a head end thereof;

a blade pivotally connected around an axis to said head end of said handle, wherein said blade has a tang, a cutting edge, a retracted position in which at least a portion of said cutting edge is inside said handle, and an extended position in which a majority of said cutting edge is outside said handle;

a cantilever connected to said handle, wherein said cantilever is biased orthogonal to said axis toward said blade at said head end of said handle; and an insert connected to said cantilever, wherein said insert separates said cantilever from said blade when said blade moves between said retracted and extended positions wherein said insert has a first end opposed to a second end thereof, said first end of said insert is closer to said head end of said handle than said second end of said insert, and said second end not said first end of said insert is biased against said tang of said blade when said blade is in said extended position.

12. The folding knife as in claim 11, wherein said cantilever is connected to said handle at said butt end of said handle.

13. The folding knife as in claim 11, wherein said blade slides against said insert when said blade moves between said retracted and extended positions.

14. The folding knife as in claim 11, wherein said insert has an insert hardness, said cantilever has a cantilever hardness, and said insert hardness is greater than said cantilever hardness.

15. The folding knife as in claim 11, wherein said first end of said insert is biased against said tang of said blade when said blade is in said retracted position.

16. The folding knife as in claim 11, wherein said insert is releasably connected to said cantilever.

* * * * *